US007779797B2

(12) United States Patent
Sugimoto et al.

(10) Patent No.: US 7,779,797 B2
(45) Date of Patent: Aug. 24, 2010

(54) ENGINE VALVE OPERATING SYSTEM

(75) Inventors: Mitsuru Sugimoto, Saitama (JP); Chihaya Sugimoto, Saitama (JP); Fumihisa Takemoto, Saitama (JP); Hirokazu Tochiki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 303 days.

(21) Appl. No.: 12/066,372

(22) PCT Filed: Aug. 16, 2006

(86) PCT No.: PCT/JP2006/316091

§ 371 (c)(1),
(2), (4) Date: Mar. 10, 2008

(87) PCT Pub. No.: WO2007/029458

PCT Pub. Date: Mar. 15, 2007

(65) Prior Publication Data

US 2009/0126666 A1 May 21, 2009

(30) Foreign Application Priority Data

Sep. 8, 2005 (JP) ..... 2005-260088
Sep. 8, 2005 (JP) ..... 2005-260089
Sep. 8, 2005 (JP) ..... 2005-260090
Sep. 8, 2005 (JP) ..... 2005-260091

(51) Int. Cl.
*F01L 1/34* (2006.01)

(52) U.S. Cl. ..... 123/90.16; 123/90.15; 123/90.39

(58) Field of Classification Search ..... 123/90.15, 123/90.16, 90.31
See application file for complete search history.

(56) References Cited

U.S. PATENT DOCUMENTS 5,329,891 A 7/1994 Murphy et al.
6,021,750 A 2/2000 Hertrich
6,588,387 B2 * 7/2003 Cecur ..... 123/90.46
6,659,053 B1 12/2003 Cecur
2005/0150472 A1 7/2005 Fujii et al.

FOREIGN PATENT DOCUMENTS

DE 42 20 816 A1 1/1994
DE 199 60 742 A1 6/2001

(Continued)

*Primary Examiner*—Zelalem Eshete
(74) *Attorney, Agent, or Firm*—Arent Fox LLP

(57) ABSTRACT

An engine valve operating system is provided in which a roller in rolling contact with a valve operating cam of a camshaft is axially supported via a roller shaft on a roller support portion provided on a first rocker arm, a second rocker arm having a cylindrical boss portion pivotably supported on a support shaft and an arm portion extending from the boss portion and having a sliding surface that is in sliding contact with the roller shaft is operatively connected to an engine valve, and the position of either one of first and second rocker arm swing axes is changed within a plane perpendicular to the axis of the camshaft, wherein at least the roller support portion (38) of the first rocker arm (23) is disposed at a position that overlaps the second rocker arm (26A, 26B) in plan view. This can provide an engine valve operating system that enables the size thereof to be reduced in a direction along the axis of the camshaft.

15 Claims, 13 Drawing Sheets

FOREIGN PATENT DOCUMENTS

| | | | |
|---|---|---|---|
| EP | 0 717 174 | A1 | 6/1996 |
| EP | 0 995 885 | A2 | 4/2000 |
| EP | 1 515 009 | A1 | 3/2005 |
| JP | 6-307219 | A | 11/1994 |
| JP | 8-165910 | A | 6/1996 |
| JP | 08-218831 | A | 8/1996 |
| JP | 9-502002 | A | 2/1997 |
| JP | 11-36833 | A | 2/1999 |
| JP | 2000-130132 | A | 5/2000 |
| JP | 2001-500207 | A | 1/2001 |
| JP | 2001-164911 | A | 6/2001 |
| JP | 2001-193426 | A | 7/2001 |
| JP | 2002-129916 | B2 | 5/2002 |
| JP | 2005-098140 | A | 4/2005 |
| JP | 2005-248797 | A | 9/2005 |
| JP | 2005-344702 | A | 12/2005 |
| JP | 2006-70733 | A | 3/2006 |

* cited by examiner

ENGINE VALVE OPERATING SYSTEM

CROSS-REFERENCE TO RELATED APPLICATION

This application is a National Stage entry of International Application No. PCT/JP2006/316091, filed Aug. 16, 2006, the entire specification claims and drawings of which are incorporated herewith by reference.

TECHNICAL FIELD

The present invention relates to an engine valve operating system that includes a camshaft having a valve operating cam provided thereon, a first rocker arm that can swing around a first axis parallel to an axis of the camshaft, a roller that is axially supported, via a roller shaft, on a roller support portion provided on the first rocker arm and that is in rolling contact with the valve operating cam, and a second rocker arm that has a sliding surface in sliding contact with the roller shaft, is operatively connected to an engine valve, and can swing around a second axis parallel to the first axis, the position of either one of the first and second axes changing within a plane perpendicular to the axis of the camshaft.

BACKGROUND ART

Such an engine valve operating system is already known from Patent Publication 1.

Patent Publication 1: Japanese Patent Application Laid-open No. 2001-164911

DISCLOSURE OF INVENTION

Problems to be Solved by the Invention

However, in the arrangement disclosed in Patent Publication 1 above, the first rocker arm is disposed at a position offset outward in a direction along the axis of the camshaft relative to the portion of the second rocker arm operatively connected to the engine valve, and the valve operating system becomes large in the direction along the axis of the camshaft.

The present invention has been accomplished under such circumstances, and it is an object thereof to provide an engine valve operating system that can be reduced in size in a direction along the axis of a camshaft.

Means for Solving the Problems

In order to attain the above object, according to a first aspect of the present invention, there is provided an engine valve operating system comprising a camshaft having a valve operating cam provided thereon, a first rocker arm that can swing around a first axis parallel to an axis of the camshaft, a roller that is axially supported, via a roller shaft, on a roller support portion provided on the first rocker arm and that is in rolling contact with the valve operating cam, and a second rocker arm that has a sliding surface in sliding contact with the roller shaft, is operatively connected to an engine valve, and can swing around a second axis parallel to the first axis, the position of either one of the first and second axes changing within a plane perpendicular to the axis of the camshaft, characterized in that at least the roller support portion of the first rocker arm is disposed at a position that overlaps the second rocker arm in plan view.

Further, in order to attain the above object, according to a second aspect of the present invention, there is provided an engine valve operating system comprising a camshaft having a valve operating cam provided thereon, a first rocker arm that can swing around a first axis parallel to an axis of the camshaft, a roller that is axially supported, via a roller shaft, on a roller support portion provided on the first rocker arm and that is in rolling contact with the valve operating cam, and a second rocker arm that has a sliding surface in sliding contact with the roller shaft, is operatively connected to an engine valve, and can swing around a second axis parallel to the first axis, the position of either one of the first and second axes changing within a plane perpendicular to the axis of the camshaft, characterized in that a spacing between the sliding surfaces individually corresponding to a plurality of the engine valves is set so as to be smaller than a spacing between the engine valves.

According to a third aspect of the present invention, in addition to the second aspect, the second rocker arm integrally comprises a boss portion pivotably supported on a support shaft that has the second axis, an arm portion that has the sliding surface and extends from the boss portion, a valve connection portion that projects outward from the forward end of the arm portion and is operatively connected to the engine valve, and a reinforcing wall portion that provides a connection between the valve connection portion and an outside face of the arm portion.

According to a fourth aspect of the present invention, in addition to the first or second aspect, the second rocker arm is provided with a cylindrical boss portion pivotably supported on a support shaft that has the second axis and with an arm portion that has the sliding surface and extends from the boss portion, and the boss portion is provided with a cutout so that it avoids interfering with at least one of the roller and the roller support portion of the first rocker arm.

According to a fifth aspect of the present invention, in addition to the fourth aspect, the boss portion is provided with the cutout so as to avoid interfering with the roller and the roller support portion.

According to a sixth aspect of the present invention, in addition to the fourth aspect, the cutout is formed so that part of the outer periphery of the support shaft is exposed.

According to a seventh aspect of the present invention, in addition to the sixth aspect, an oil guide surface communicating with the cutout is formed on the second rocker arm so as to face upward.

According to an eighth aspect of the present invention, in addition to the first or second aspect, the second rocker arm comprises a cylindrical boss portion pivotably supported on a support shaft that has the second axis, an arm portion that has the sliding surface and extends from the boss portion, and a reinforcing wall portion provided between the boss portion and a side face of the arm portion.

According to a ninth aspect of the present invention, in addition to the eighth aspect, the reinforcing wall portion facing the roller support portion or the roller is formed at a position set back from the sliding surface toward the side opposite to the roller shaft.

According to a tenth aspect of the present invention, in addition to the first or second aspect, the second rocker arm comprises a cylindrical boss portion pivotably supported on a support shaft that has the second axis, and an arm portion that has the sliding surface and extends from the boss portion, and a pair of the arm portions having valve connection portions provided on a forward end part are integrally connected to each other via a connecting portion, the valve connection portions being operatively connected to the engine valves.

According to an eleventh aspect of the present invention, in addition to the tenth aspect, an oil reservoir for holding oil is formed in the connecting portion so that oil can be put onto the surface of the roller in response to swinging of the second rocker arm.

According to a twelfth aspect of the present invention, in addition to the first or second aspect, an oil retaining recess for holding oil is formed in the sliding surface of the second rocker arm.

According to a thirteenth aspect of the present invention, in addition to the twelfth aspect, the oil retaining recess is formed as a groove within a plane perpendicular to the axis of the roller shaft.

According to a fourteenth aspect of the present invention, in addition to the twelfth or thirteenth aspect, the second rocker arm, which is pivotably supported by a support shaft that has the second axis, is provided with an oil outlet that communicates with an oil supply path provided within the support shaft and discharges oil toward the oil retaining recess.

According to a fifteenth aspect of the present invention, in addition to the thirteenth aspect, the oil retaining recess is formed so as to gradually become shallow in going toward the second axis side.

EFFECTS OF THE INVENTION

In accordance with the arrangement of the first aspect, at least the roller support portion of the first rocker arm overlaps the second rocker arm in plan view, and it is possible to reduce the amount of displacement, in a direction along the axis of the camshaft, of the first rocker arm relative to the second rocker arm, which is operatively connected to the engine valve, thereby enabling the valve operating system to be reduced in size in the direction along the axis of the camshaft.

Furthermore, in accordance with the arrangement of the second aspect, regardless of the position at which the first rocker arm is disposed in the direction along the axis of the camshaft relative to the sliding surface of the second rocker arm, since the sliding surface of the second rocker arm is disposed within an area that is narrower than the spacing between the plurality of engine valves, the valve operating system can be reduced in size in the direction along the axis of the camshaft.

In accordance with the arrangement of the third aspect, since the spacing between the sliding surfaces is smaller than the spacing between the engine valves, the valve connection portion of the second rocker arm, which is operatively connected to the engine valve, is inevitably disposed so as to protrude outward from the forward end of the arm portion having the sliding surface, but since the outside face of the arm portion and the valve connection portion are connected via the reinforcing wall portion, the rigidity of the joint between the valve connection portion and the arm portion can be enhanced.

In accordance with the arrangement of the fourth aspect, even if the sliding surface is disposed close to the support shaft, which swingably supports the boss portion of the second rocker arm, it is possible to avoid interference of at least one of the roller and the roller support portion of the first rocker arm with the boss portion, and the length of the second rocker arm can therefore be set short, thereby contributing to a reduction in the size of the valve operating system.

In accordance with the arrangement of the fifth aspect, it is possible to avoid interference of both the roller and the roller support portion of the first rocker arm with the boss portion and to dispose the sliding surface close to the support shaft, thus enabling the length of the second rocker arm to be set shorter and thereby contributing to a reduction in the size of the valve operating system.

In accordance with the arrangement of the sixth aspect, since part of the outer periphery of the support shaft is exposed, it is possible to guide oil from the cutout to the area between the support shaft and the boss portion, thus enabling the area between the second rocker arm and the support shaft to be well lubricated.

In accordance with the arrangement of the seventh aspect, since oil can be guided to the cutout via the oil guide surface, lubrication between the second rocker arm and the support shaft can be carried out more efficiently.

In accordance with the arrangement of the eighth aspect, since the second rocker arm is provided with the reinforcing wall portion between the boss portion and the side face of the arm portion, the rigidity of the second rocker arm can be enhanced, thereby making the engine valve accurately follow the profile of the valve operating cam so as to be opened and closed.

In accordance with the arrangement of the ninth aspect, providing the reinforcing wall portion avoids any increase in the vertical width of the second rocker arm.

In accordance with the arrangement of the tenth aspect, with regard to the second rocker arm, since the pair of arm portions having the valve connection portion operatively connected to the engine valve provided at the forward ends are connected integrally to each other via the connecting portion, it is possible to enhance the rigidity of the second rocker arm, thereby making the engine valve accurately follow the profile of the valve operating cam so as to be opened and closed.

In accordance with the arrangement of the eleventh aspect, the area between the roller and the valve operating cam can be well lubricated.

In accordance with the arrangement of the twelfth aspect, by holding oil in the oil retaining recess formed in the sliding surface, the oil is supplied to the area between the roller shaft and the sliding surface, thus reducing the frictional resistance between the roller shaft and the sliding surface.

In accordance with the arrangement of the thirteenth aspect, it is possible to easily form an oil retaining recess that covers the whole area over which the sliding surface is in sliding contact with the roller shaft.

In accordance with the arrangement of the fourteenth aspect, it is possible to reliably supply oil to the oil retaining recess.

Moreover, in accordance with the arrangement of the fifteenth aspect, it is possible to suppress any decrease in the rigidity of the second rocker arm due to formation of the oil retaining recess.

EXPLANATION OF REFERENCE NUMERALS AND SYMBOLS

Figure 1:
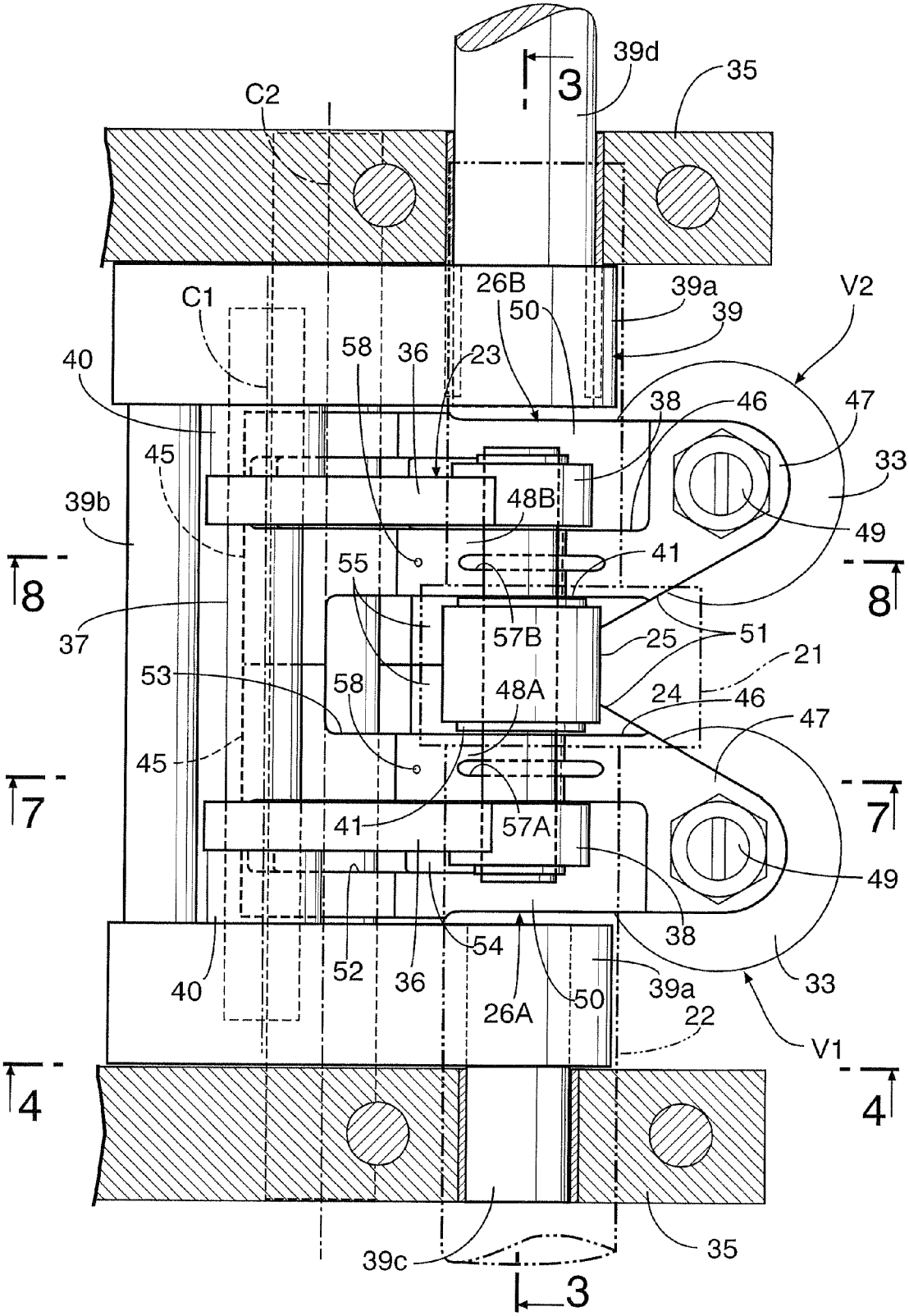
FIG. 1 A plan view of a valve operating system of a first embodiment (first embodiment).
Figure 2:
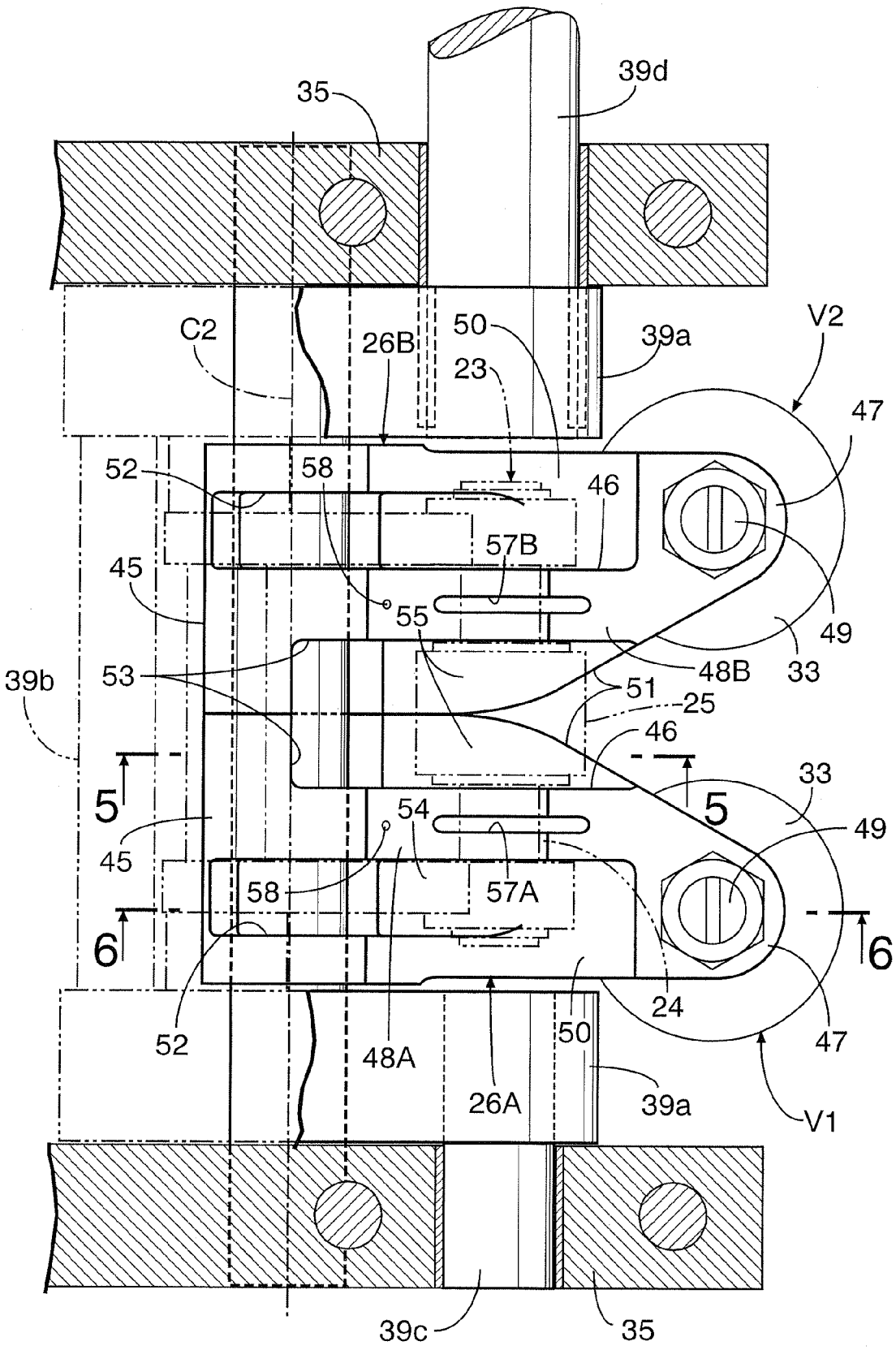
FIG. 2 A plan view of the valve operating system with a control shaft and a first rocker arm omitted (first embodiment).
Figure 3:
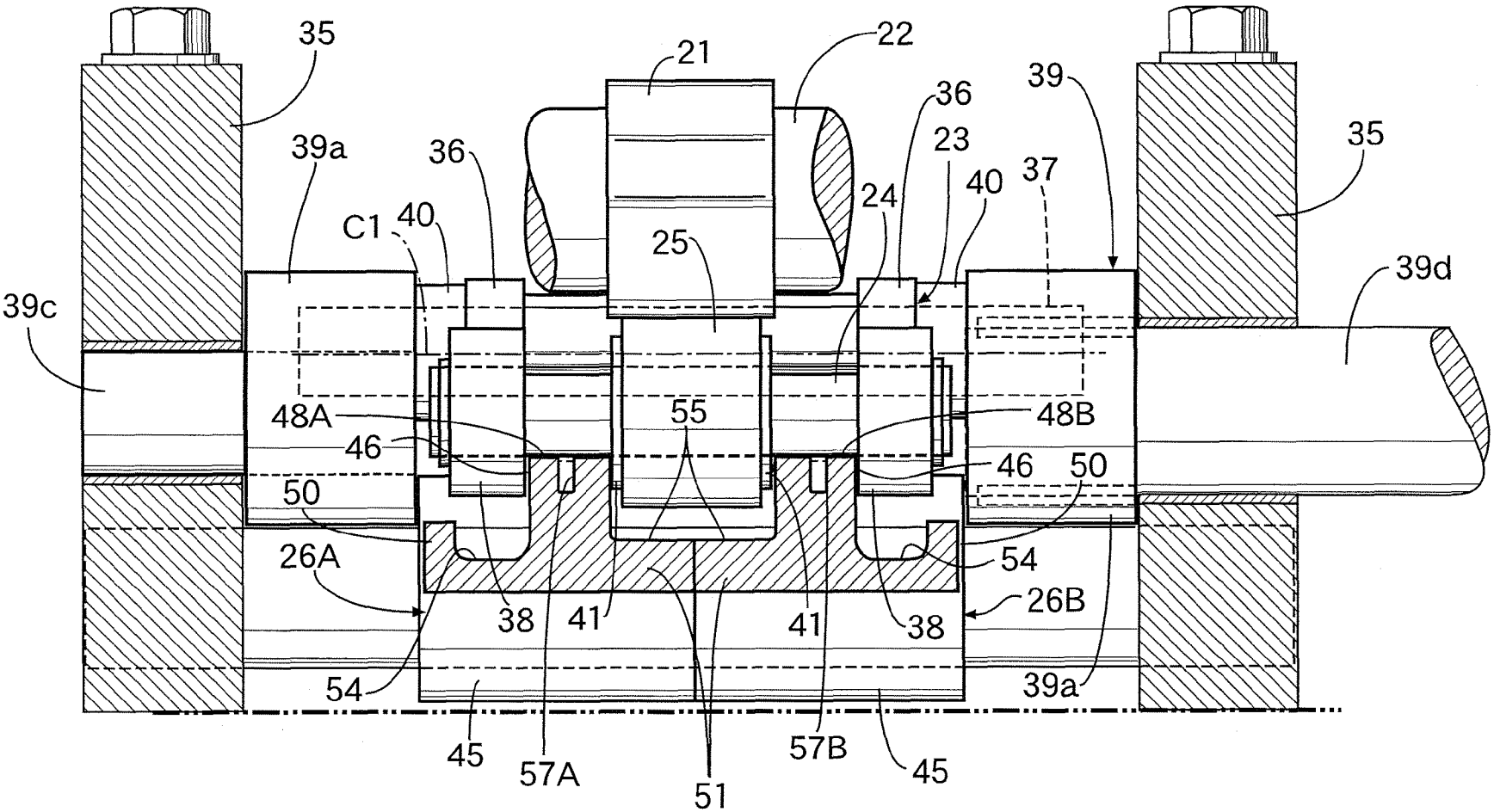
FIG. 3 A sectional view along line 3-3 in FIG. 1 (first embodiment).

21 Valve operating cam
22 Camshaft
23 First rocker arm
24 Roller shaft
25 Roller
26A, 26B, 64 Second rocker arm
38 Roller support portion
44 Support shaft
45, 65 Boss portion
46, 66 Arm portion
47, 67 Valve connection portion
48A, 48B, 68 Sliding surface
50, 51, 69 Reinforcing wall portion
52, 53, 72 Cutout
54, 55 Oil guide surface
57A, 57B, 74 Oil retaining recess
58, 75 Oil outlet
59 Oil supply path
67 Valve connection portion
70, 71 Connecting portion
73 Oil reservoir
C1 First axis
C2 Second axis
V1, V2 Intake valve, which is an engine valve

BEST MODE FOR CARRYING OUT THE INVENTION

Modes for carrying out the present invention are explained below by reference to Embodiments of the present invention shown in the attached drawings.

Embodiment 1

Referring to FIG. 1 to FIG. 9, a first embodiment of the present invention is explained. First, in FIG. 1 to FIG. 3, this valve operating system includes a camshaft 22 provided with a common valve operating cam 21 for a pair of engine valves, for example, first and second intake valves V1 and V2, a first rocker arm 23 that can swing around a first axis C1 parallel to the axis of the camshaft 22, a roller 25 that is axially supported, via a roller shaft 24, on roller support portions 38 and 38 provided on the first rocker arm 23 and is in rolling contact with the valve operating cam 21, and a pair of second rocker arms 26A and 26B that have sliding surfaces 48A and 48B in sliding contact with the roller shaft 24, are individually operatively connected to the two intake valves V1 and V2, and can pivot around a second axis C2 that is parallel to the first axis C1, and the position of one of the first and second axes C1 and C2, the first axis C1 in this embodiment, can be changed within a plane perpendicular to the axis of the camshaft 22.

Figure 4:
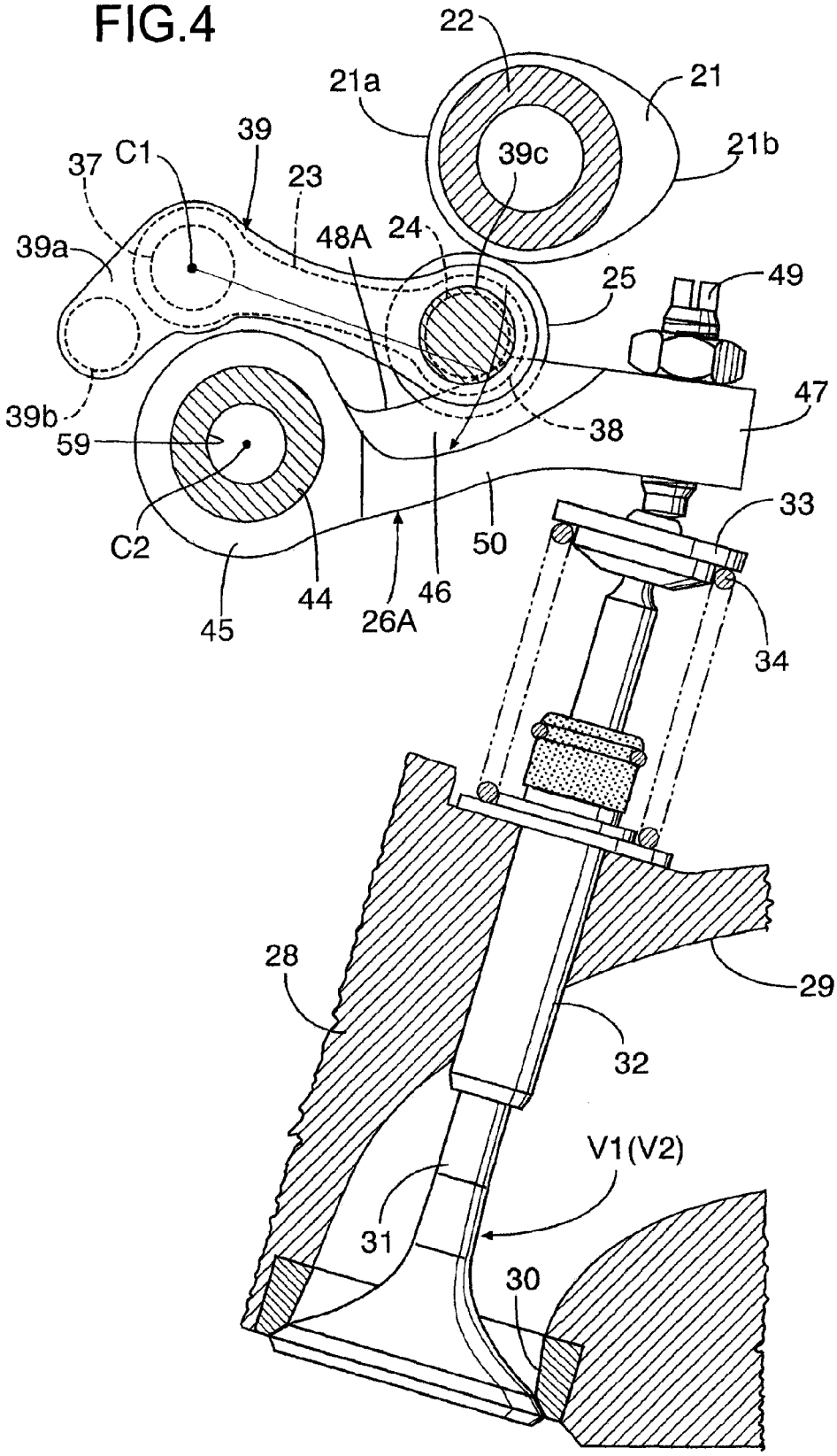
FIG. 4 A sectional view along line 4-4 in FIG. 1 (first embodiment).

In FIG. 4, an engine cylinder head 28 is provided with an intake port 29 and a pair of intake valve openings 30 communicating with the intake port 29, stem portions 31 of the first and second intake valves V1 and V2 for opening and closing the intake valve openings 30 are slidably fitted into guide tubes 32 provided in the cylinder head 28, and valve springs 34 urging the first and second intake valves V1 and V2 toward the valve-closed side are provided in a compressed state between the cylinder head 28 and retainers 33 provided at end parts of the stem portions 31 projecting from the guide tubes 32.

The cylinder head 28 is provided with holders 35 disposed on opposite sides of the first and second intake valves V1 and V2, and the camshaft 22 is rotatably supported by these holders 35. The first rocker arm 23 is disposed between the two holders 35 and 35 and is formed from a pair of first arm portions 36 and 36 spaced in a direction along the axis of the camshaft 22 and arranged along a plane perpendicular to the axis of the camshaft 22, and a movable support shaft 37 having the first axis C1 and connecting base portions of the two first arm portions 36 and 36, and opposite end parts of the roller shaft 24 are supported between the circular roller support portions 38 and 38 provided at forward ends of the two first arm portions 36 and 36.

Opposite ends of the movable support shaft 37 of the first rocker arm 23 project outwardly from the two first arm portions 36 and 36, and the opposite ends of the movable support shaft 37 are pivotably supported by a control shaft 39. This control shaft 39 includes webs 39*a* and 39*a* disposed between the two first arm portions 36 and 36 of the first rocker arm 23 and the pair of holders 35 and 35, a connecting shaft 39*b* that has an axis parallel to the movable support shaft 37 and provides a connection between the two webs 39*a* and 39*a*, and pivot shafts 39*c* and 39*d* that have an axis parallel to the connecting shaft 39*b* and are connected to outside faces of the two webs 39*a* and 39*a*, the pivot shafts 39*c* and 39*d* being pivotably supported by the holders 35 and 35. The roller shaft 24 is provided between the two roller support portions 38 and 38 so that it is coaxial with the axes of the pivot shafts 39*c* and 39*d* of the control shaft 39 when the first and second intake valves V1 and V2 are in a valve-closed and seated state.

Opposite end parts of the movable support shaft 37 of the first rocker arm 23 run through short cylindrical spacers 40 and 40 disposed between the webs 39*a* and 39*a* and the two first arm portions 36 and 36 of the first rocker arm 23 and are pivotably supported by the two webs 39*a* and 39*a*. An actuator (not illustrated) for pivoting the pivoting shaft 39*d* is connected to one, that is, 39*d*, of the two pivot shafts 39*c* and 39*d*, and pivoting the control shaft 39 around the axes of the pivot shafts 39*c* and 39*d* by the actuator pivots the movable support shaft 37 of the first rocker arm 23, that is, the first axis C1, around the axes of the pivot shafts 39*c* and 39*d*.

The roller 25 is axially supported on a middle section of the roller shaft 24 with equal spacings from the pair of roller support portions 38 and 38, and a pair of stopper rings 41 and 41 for determining the axial position of the roller 25 are mounted on the roller shaft 24 on opposite sides of the roller 25.

The pair of second rocker arms 26A and 26B have, except in one part, a basically substantially symmetrical shape relative to a plane passing through the axial center of the roller 25. One second rocker arm 26A, which corresponds to the first intake valve V1, is explained in detail below, and the other second rocker arm 26B, which corresponds to the second intake valve V2, is not explained in detail apart from parts that are different from the one second rocker arm 26A by using the same reference numerals and symbols as those for the one second rocker arm 26A for corresponding parts in the drawings.

The one second rocker arm 26A is disposed beneath the first rocker arm 23, integrally has a cylindrical boss portion 45 pivotably supported on a stationary support shaft 44 having the second axis C2, a second arm portion 46 extending from the boss portion 45, and a valve connection portion 47 provided at the forward end of the second arm portion 46 so as to be operatively connected to the first intake valve V1, and a sliding surface 48A is provided on an upper face of the second arm portion 46, the sliding surface 48A being in sliding contact with a section of the roller shaft 24 between the roller 25 and the roller support portion 38.

The stationary support shaft 44 is fixedly supported by the holders 35, and the second arm portion 46 is provided so as to be connected to an axially middle section of the boss portion 45 while extending within a plane perpendicular to the second axis C2 of the stationary support shaft 44.

The valve connection portion 47 is provided so as to be connected to a forward end part of the second arm portion 46 so as to project outward from the forward end of the second arm portion 46. A tappet screw 49 is screwed into the valve connection portion 47 so that its position can be adjusted back and forth, and the tappet screw 49 abuts against the upper end of the stem portion 31 of the first intake valve V1. That is, the valve connection portion 47 is operatively connected to the first intake valve V1 via the tappet screw 49.

The one second rocker arm 26A is provided with a reinforcing wall portion 50 that provides a connection between the valve connection portion 47 and an outside face of the second arm portion 46 and a connection between the outside face of the second arm portion 46 and a portion of the boss portion 45 that projects outward from the second arm portion 46, the reinforcing wall portion 50 facing the roller support portion 38 of the first rocker arm 23. Moreover, the reinforcing wall portion 50 is formed so as to face the roller support portion 38 at a position set back from the sliding surface 48A of the second arm portion 46 toward the side opposite to the roller shaft 24.

Figure 5:
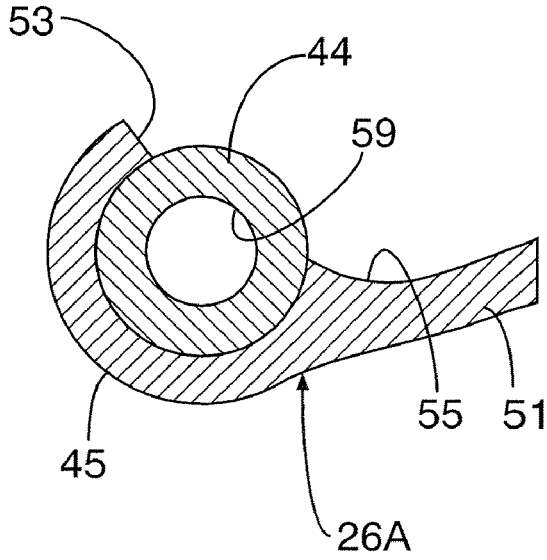
FIG. 5 A sectional view along line 5-5 in FIG. 2 (first embodiment).

In FIG. 5, the one second rocker arm 26A is provided with a reinforcing wall portion 51 that provides a connection between a portion of the boss portion 45 projecting inward from the second arm portion 46 and an inside face of the second arm portion 46 and that faces the roller 25, and this reinforcing wall portion 51 is formed so as to face the roller 25 at a position set back from the sliding surface 48A toward the side opposite to the roller shaft 24.

The first rocker arm 23, which is disposed above the one second rocker arm 26A, is formed so that at least one roller support portion 38 overlaps the one second rocker arm 26A in plan view, and in this embodiment the first rocker arm 23 is formed so that a majority thereof overlaps the one second rocker arm 26A in plan view.

Figure 6:
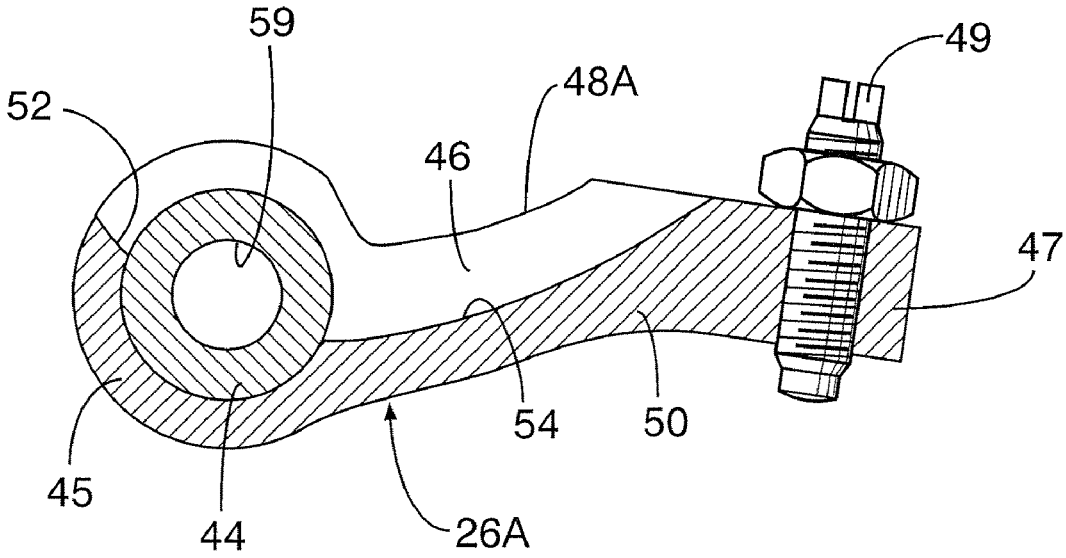
FIG. 6 A sectional view along line 6-6 in FIG. 2 (first embodiment).

Referring in addition to FIG. 6, the boss portion 45 of the one second rocker arm 26A is provided with a cutout so that interference with at least one of the roller 25 and the roller support portion 38 of the first rocker arm 23 is avoided and, in this embodiment, cutouts 52 and 53 so that interference with both thereof is avoided, and the two cutouts 52 and 53 are formed so that part of the outer periphery of the stationary support shaft 44 is exposed.

Moreover, an oil guide surface 54 facing upward and communicating with one cutout 52 is formed on part of an upper face of the reinforcing wall portion 50, which is provided on the one second rocker arm 26A so as to provide a connection between the valve connection portion 47 and the outside face of the second arm portion 46 and a connection between the outside face of the second arm portion 46 and the portion of the boss portion 45 projecting outward from the second arm portion 46, and an oil guide surface 55 facing upward and communicating with the other cutout 53 is formed on an upper face of the reinforcing wall portion 51, which faces the one second rocker arm 26A and provides a connection between the inside face of the second arm portion 46 and the portion of the boss portion 45 projecting inward from the second arm portion 46.

Figure 7:
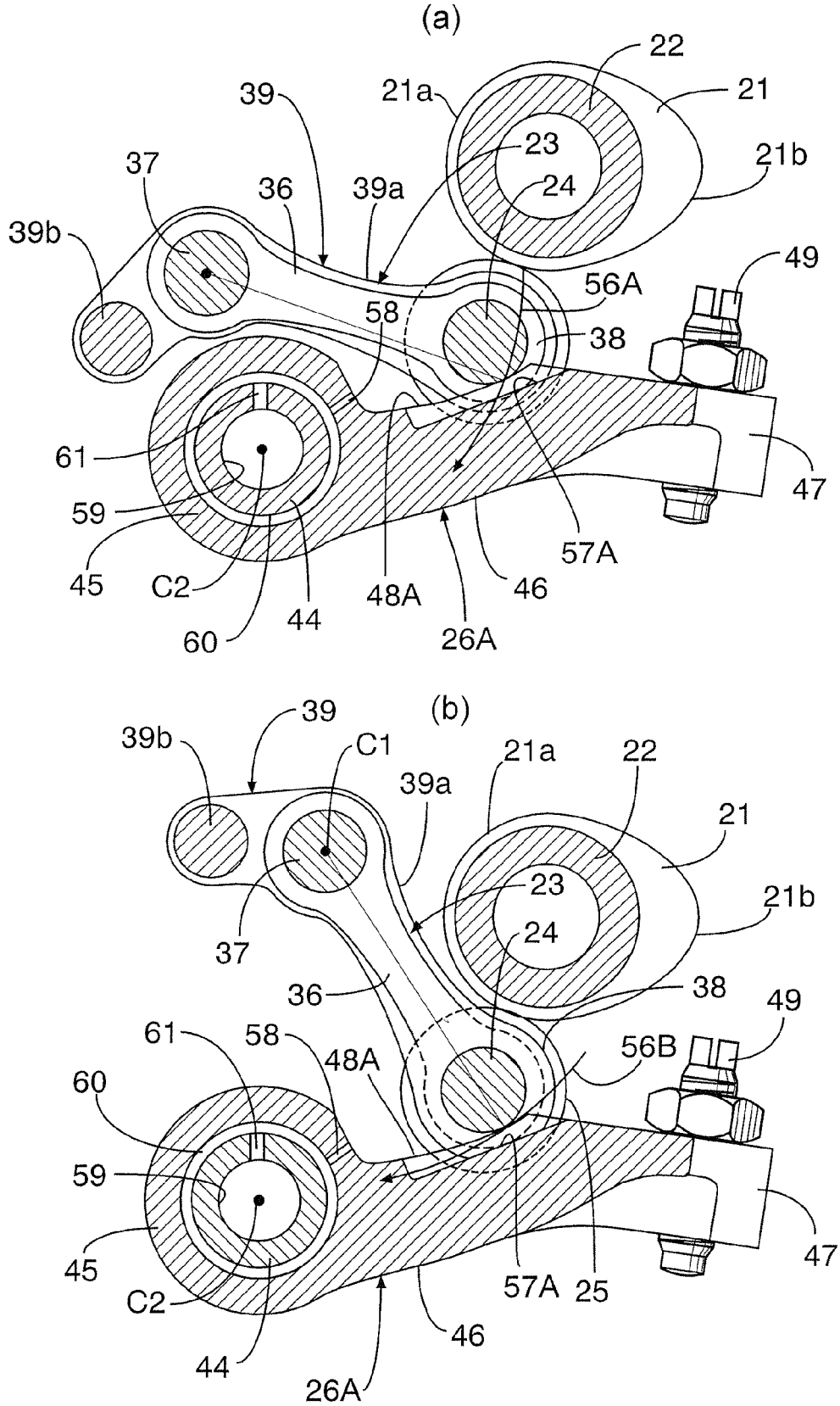
FIG. 7 A sectional view along line 7-7 in FIG. 1 in a maximum lift state (a) and a minimum lift state (b) (first embodiment).

As shown in FIGS. 7 (*a*) and (*b*), a contact point between the roller shaft 24 and the sliding surface 48A provided on the second arm portion 46 of the one second rocker arm 26A moves along arcs 56A and 56B that have a center on the first axis C1 and pass through the contact point of the roller shaft 24 with the sliding surface 48A on the side spaced from the stationary support shaft 44 when the roller 25 is in sliding contact with a base circle portion 21*a* of the valve operating cam 21, and movement of the roller shaft 24 along the arcs 56A and 56B pushes the one second rocker arm 26A downward, thus lifting the first intake valve V1 in a direction that opens the valve.

The movable support shaft 37 of the first rocker arm 23 changes position between a lower position at which the control shaft 39 is at a maximum lift position shown in FIG. 7(*a*) and an upper position at which the control shaft 39 is at a minimum lift position shown in FIG. 7(*b*), and the sliding surface 48A of the one second rocker arm 26A is formed so that part thereof on the stationary support shaft 44 side is at a position displaced toward the first axis C1 side from the arc 56B in the minimum lift state shown in FIG. 7(*b*). That is, even in the minimum lift state, the sliding surface 48A is formed so that the one second rocker arm 26A is swung to the side that lifts the first intake valve V1 so as to open it.

An oil retaining recess 57A that can retain oil is formed in the sliding surface 48A of the one second rocker arm 26A, and this oil retaining recess 57A is formed as a groove within a plane perpendicular to the axis of the roller shaft 24.

Furthermore, an oil outlet 58 opening toward the oil retaining recess 57A side is provided in the boss portion 45 of the one second rocker arm 26A. An oil supply path 59 is provided within the stationary support shaft 44, oil being supplied to the supply path 59 from an oil supply source (not illustrated), an annular recess 60 communicating with the oil outlet 58 is provided on the outer periphery of the stationary support shaft 44, and a through hole 61 providing communication between the annular recess 60 and the oil supply path 59 is provided in the stationary support shaft 44. That is, oil is discharged toward the oil retaining recess 57A via the oil outlet 58, which communicates with the oil supply path 59 within the stationary support shaft 44.

Said other second rocker arm 26B is formed in the same arrangement as that of the one second rocker arm 26A except that the second arm portion 46 is provided with the sliding surface 48B and an oil retaining recess 57B, which are different from the sliding surface 48A and the oil retaining portion 57A of the one second rocker arm 26A; the two second rocker arms 26A and 26B have inner ends of their boss portions 45 and 45 in sliding contact with each other and are disposed beneath the first rocker arm 23, and the spacing between the sliding surfaces 48A and 48B of the two second rocker arms 26A and 26B is set so as to be shorter than the spacing between the first and second intake valves V1 and V2.

Figure 8A:
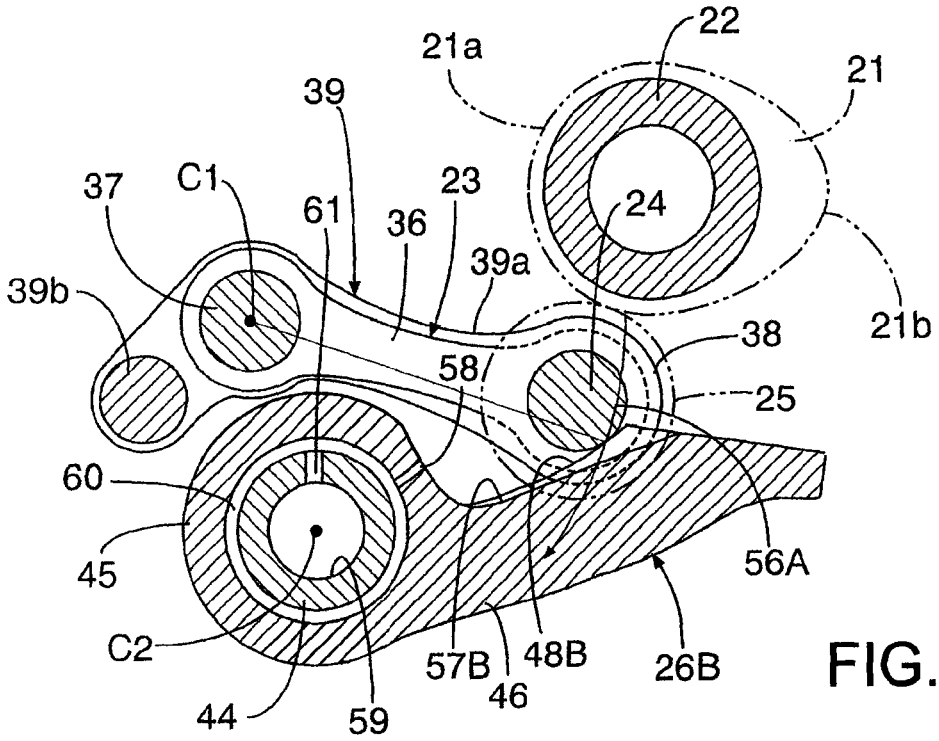
FIG. 8 A sectional view along line 8-8 in FIG. 1 in a maximum lift state (a) and a minimum lift state (b) (first embodiment).
Figure 8B:
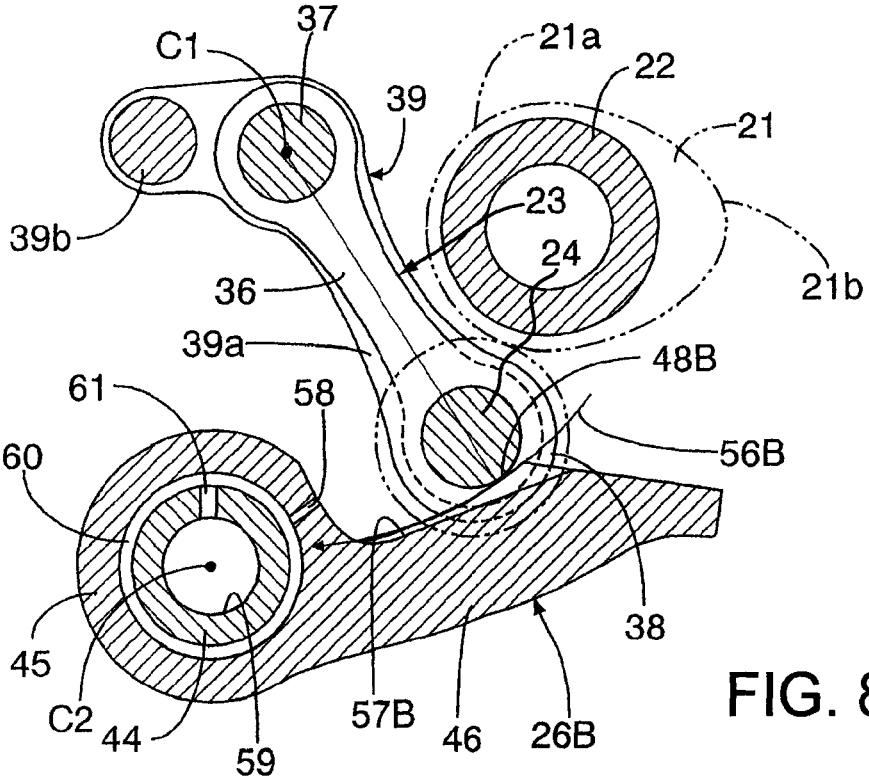

In FIG. 8, a contact point between the roller shaft 24 and the sliding surface 48B provided on the second arm portion 46 of said other second rocker arm 26B moves along arcs 56A and 56B that have a center on the first axis C1 and pass through the contact point of the roller shaft 24 with the sliding surfaces 48B on the side spaced from the stationary support shaft 44 when the roller 25 is in sliding contact with the base circle portion 21*a* of the valve operating cam 21 in either the state when the control shaft 39 is at a maximum lift position shown in FIG. 8(*a*) or the state when the control shaft 39 is at a minimum lift position shown in FIG. 8(*b*), and movement of the roller shaft 24 along the arcs 56A and 56B pushes said other second rocker arm 26B downward, thus lifting the second intake valve V2 in a direction that opens the valve.

Moreover, the sliding surface 48B of said other second rocker arm 26B is formed so that part thereof on the stationary support shaft 44 side is present on the same curve as the arc 56B when it is in the minimum lift state shown in FIG. 8(*b*). That is, when it is in the minimum lift state, said other second rocker arm 26B allows the second intake valve V2 to remain closed and seated.

Figure 9:
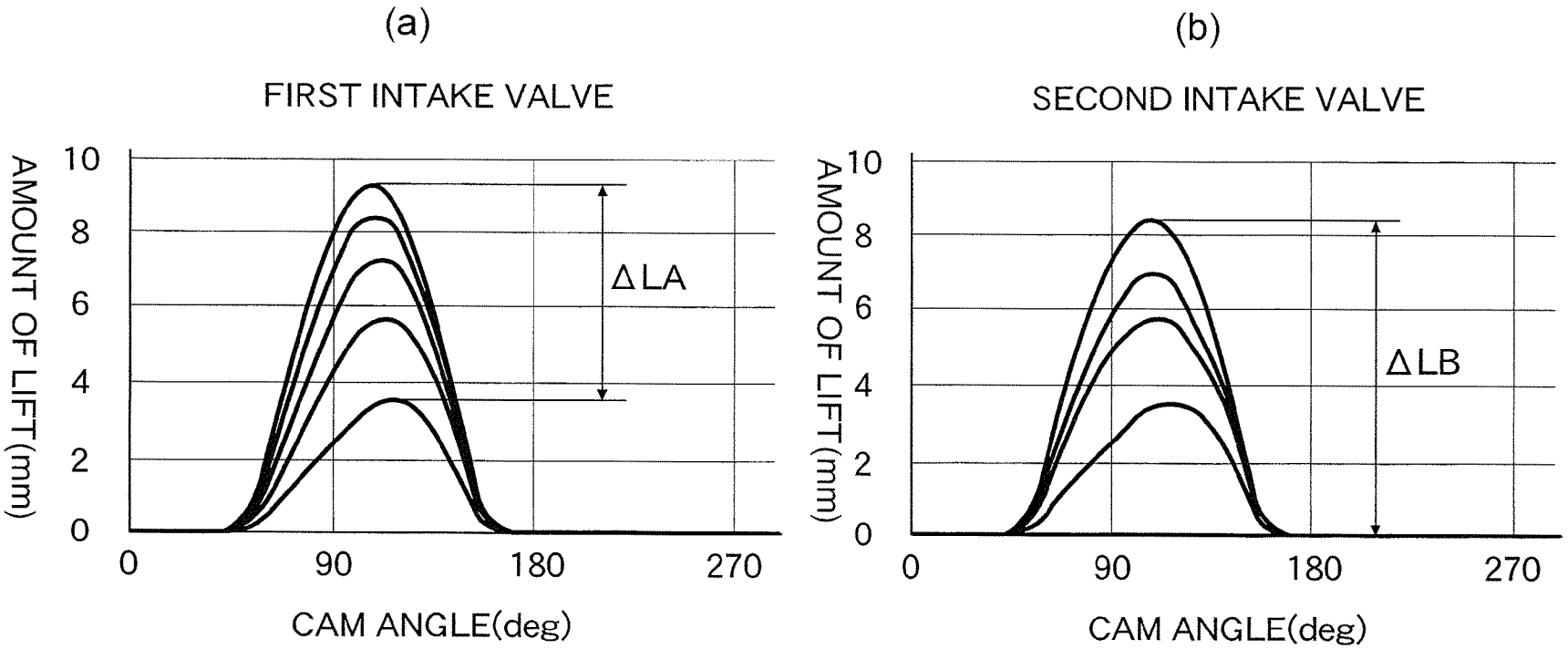
FIG. 9 A diagram showing lift characteristics of a first intake valve (a) and a second intake valve (b) respectively (first embodiment).

Since the sliding surfaces 48A and 48B of the two second rocker arms 26A and 26B are formed with different shapes from each other, the amount of lift of the first intake valve V1 changes as shown in FIG. 9(*a*) in response to change in position of the first axis C1, that is, pivoting of the control shaft 39, whereas the amount of lift of the second intake valve V2 changes as shown in FIG. 9(*b*) in response to change in position of the first axis C1, that is, pivoting of the control shaft 39 and, compared with a difference ΔLA in the amount of lift between the maximum amount of lift and the minimum amount of lift of the first intake valve V1, a difference ΔLB in the amount of lift between the maximum amount of lift and the minimum amount of lift of the second intake valve V2 is smaller.

Moreover, the oil retaining recess 57B, which can retain oil, is formed in the sliding surface 48B of said other second rocker arm 26B as a groove within a plane perpendicular to the axis of the roller shaft 24, and this oil retaining recess 57B is formed so that it gradually becomes shallow in going toward the second axis C2 side, that is, the stationary support shaft 44 side.

The operation of the first embodiment is now explained; since at least the roller support portions 38 and 38 of the first rocker arm 23 are disposed at positions that overlap the second rocker arms 26A and 26B in plan view, it is possible to reduce the amount of displacement of the first rocker arm 23 in a direction along the axis of the camshaft 22 relative to the second rocker arms 26A and 26B, which are operatively connected to the first and second intake valves V1 and V2, thus enabling the size of the valve operating system to be reduced in the direction along the axis of the camshaft 22.

Moreover, since the spacing between the sliding surfaces 48A and 48B of the pair of second rocker arms 26A and 26B individually corresponding to the first and second intake valves V1 and V2 is set so as to be smaller than the spacing between the first and second intake valves V1 and V2, even when the first rocker arm 23 is disposed at any position in the direction along the axis of the camshaft 22 relative to the sliding surfaces 48A and 48B of the second rocker arms 26A and 26B, since the sliding surfaces 48A and 48B of the second rocker arms 26A and 26B are disposed in a section that is narrower than the spacing between the first and second intake valves V1 and V2, the size of the valve operating system can be reduced in the direction along the axis of the camshaft 22.

The pair of second rocker arms 26A and 26B integrally have the boss portions 45 pivotably supported by the stationary support shaft 44 having the second axis C2, the second arm portions 46 having the sliding surfaces 48A and 48B and extending from the boss portion 45, the valve connection portions 47 projecting outward from the forward ends of the second arm portions 46 and operatively connected to the first and second intake valves V1 and V2, and the reinforcing wall portions 50 providing a connection between the valve connection portions 47 and the outside faces of the second arm portions 46; since the spacing between the sliding surfaces 48A and 48B is made smaller than the spacing between the two intake valves, the valve connection portions 47 of the second rocker arms 26A and 26B are inevitably disposed so as to project outward from the forward ends of the second arm portions 46 having the sliding surfaces 48A and 48B, but since the outside faces of the second arm portions 46 and the valve connection portions 47 are connected via the reinforcing wall portions 50, the rigidity of the joints between the valve connection portions 47 and the second arm portions 46 can be enhanced.

Moreover, since the reinforcing wall portions 50 provide a connection between the boss portions 45 of the second rocker arms 26A and 26B and the outside faces of the second arm portions 46, and the boss portions 45 and the inside faces of the second arm portions 46 are connected via the reinforcing wall portions 51, the rigidity of the second rocker arms 26A and 26B can be enhanced, thereby making the first and second intake valves V1 and V2 accurately follow the profile of the valve operating cam 21 so as to be opened and closed.

Furthermore, since the reinforcing wall portions 50 and 51 are formed so as to face the roller 25 and the roller support portions 38 of the first rocker arm 23 at positions set back from the sliding surfaces 48A and 48B toward the side opposite to the roller shaft 24, it is possible to avoid any increase in the vertical width of the second rocker arms 26A and 26B due to the reinforcing wall portions 50 and 51 being provided.

Since the boss portions 45 of the pair of second rocker arms 26A and 26B are provided with the cutouts 52 and 53 so that interference with at least one, and both in this embodiment, of the roller 25 and the roller support portions 38 of the first rocker arm 23 is avoided, even if the sliding surfaces 48A and 48B are disposed close to the stationary support shaft 44, which swingably supports the boss portions 45, it is possible to avoid at least one of the roller 25 and the roller support portions 38 of the first rocker arm 23, and both in this embodiment, interfering with the boss portions 45, thus enabling the length of the second rocker arms 26A and 26B to be set short and thereby contributing to a reduction in the size of the valve operating system.

Moreover, since the cutouts 52 and 53 are formed so that part of the outer periphery of the stationary support shaft 44 is exposed, it is possible to guide oil from the cutouts 52 and 53 to the area between the stationary support shaft 44 and the boss portions 45, thus enabling the area between the second rocker arms 26A and 26B and the stationary support shaft 44 to be well lubricated.

Furthermore, since the oil guide surfaces 54 and 55 communicating with the cutouts 52 and 53 are formed on the reinforcing wall portions 50 and 51 of the second rocker arm 26A and 26B so as to face upward, oil can be guided to the cutouts 52 and 53 via the oil guide surfaces 54 and 55, and lubrication between the second rocker arms 26A and 26B and the stationary support shaft 44 can be carried out more efficiently.

Moreover, the oil retaining recesses 57A and 57B, which can retain oil, are formed in the sliding surfaces 48A and 48B of the second rocker arm 26A and 26B, and by holding oil in the oil retaining recesses 57A and 57B oil can be supplied to the area between the roller shaft 24 and the sliding surfaces 48A and 48B, thereby reducing the frictional resistance between the roller shaft 24 and the sliding surfaces 48A and 48B.

Moreover, since the oil retaining recesses 57A and 57B are formed as grooves within the plane perpendicular to the axis of the roller shaft 24, the oil retaining recesses 57A and 57B can easily be formed across the whole area over which the sliding surfaces 48A and 48B are in sliding contact with the roller shaft 24.

Furthermore, since the oil outlets 58, which communicates with the oil supply path 59 provided within the stationary support shaft 44 and discharges oil toward the oil retaining recesses 57A and 57B, are provided in the boss portions 45 of the second rocker arm 26A and 26B, it is possible to reliably supply oil to the oil retaining recesses 57A and 57B.

Moreover, since the oil retaining recess 57B provided in the sliding surface 48B of said other second rocker arm 26B is formed so as to gradually become shallow toward the second axis C2 side, that is, the stationary support shaft 44 side, it is possible to suppress any decrease in the rigidity of the second rocker arm 26B due to formation of the oil retaining recess 57B.

As another embodiment of the present invention, a pair of valve operating cams individually corresponding to a pair of intake valves V1 and V2 may be provided on a camshaft 22, a roller in rolling contact with each of the valve operating cams is supported by the corresponding one of a pair of divided first rocker arms via a roller shaft, and the two roller shafts are in sliding contact with sliding surfaces 48A and 48B of a pair of second rocker arms 26A and 26B. By so doing, the opening and closing characteristics, including the timing of opening and closing, which are operating characteristics, of the pair of intake valves V1 and V2 can be changed in a wider range.

Embodiment 2

Referring to FIG. 10 to FIG. 14, a second embodiment of the present invention is explained. Parts corresponding to the first embodiment above are indicated by the same reference numerals and symbols and are only illustrated, and a detailed explanation is omitted.

Figure 10:
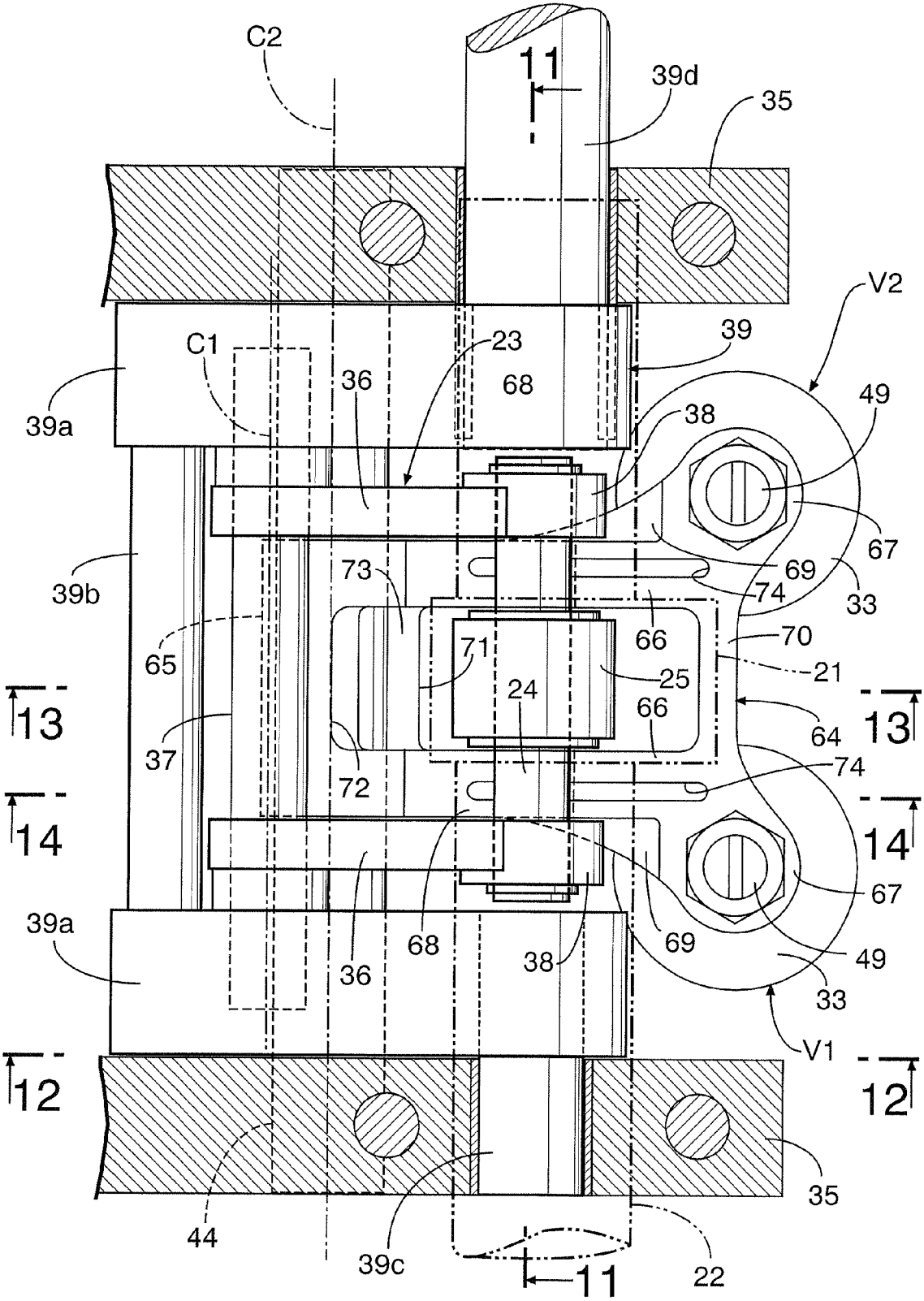
FIG. 10 A plan view of a valve operating system of a second embodiment (second embodiment).
Figure 11:
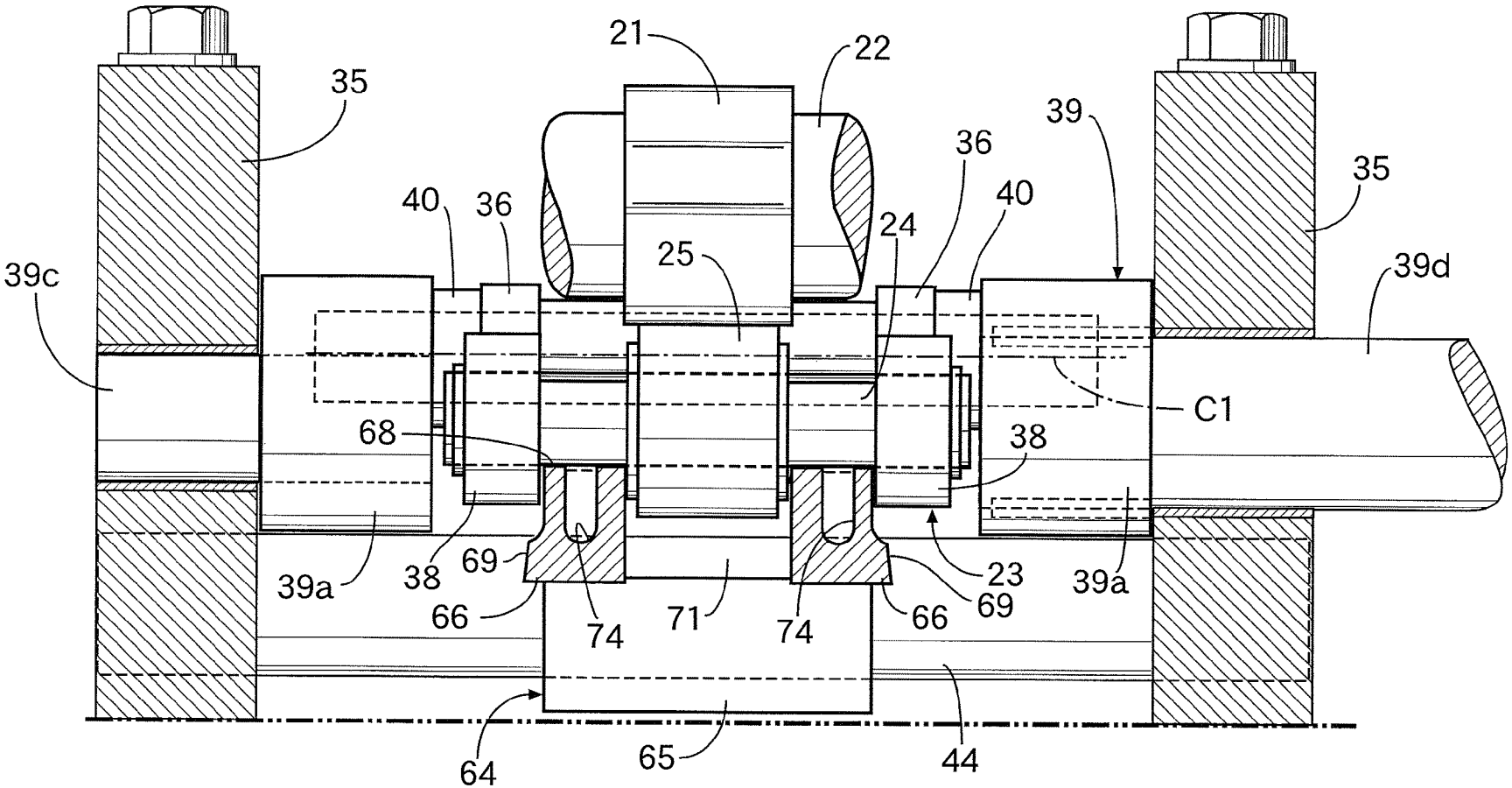
FIG. 11 A sectional view along line 11-11 in FIG. 10 (second embodiment).
Figure 12:
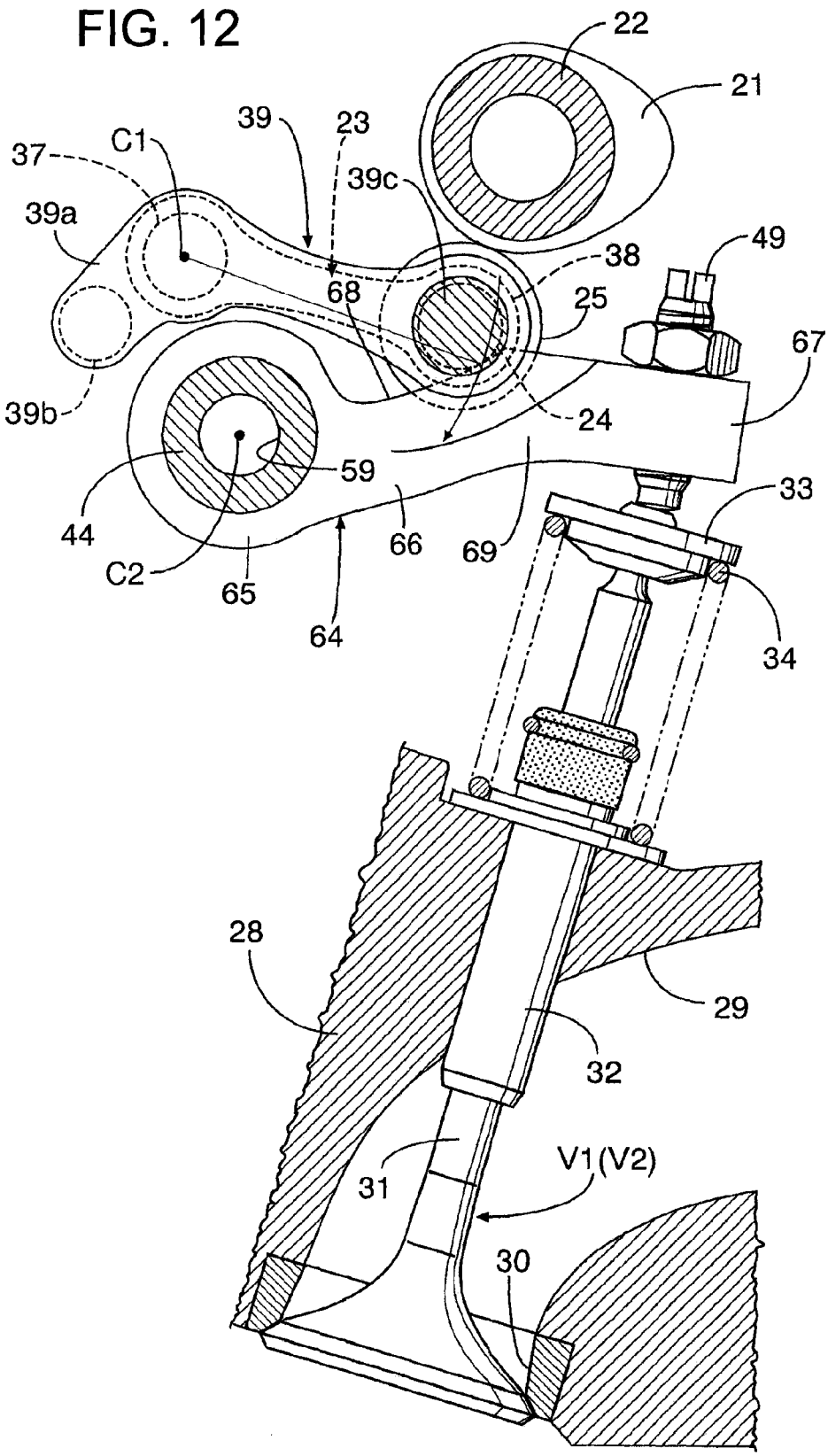
FIG. 12 A sectional view along line 12-12 in FIG. 10 (second embodiment).

First, in FIG. 10 to FIG. 12, this valve operating system includes a camshaft 22 provided with a common valve operating cam 21 for first and second intake valves V1 and V2, a first rocker arm 23 that can swing around a first axis C1 parallel to the axis of the camshaft 22, a roller 25 that is axially supported, via a roller shaft 24, on roller support portions 38 and 38 provided on the first rocker arm 23 and is in rolling contact with the valve operating cam 21, and a single second rocker arm 64 that each has sliding surfaces 68 and 68 in sliding contact with the roller shaft 24, is operatively connected individually to the two intake valves V1 and V2, and can pivot around a second axis C2 that is parallel to the first axis C1, and the position of one of the first and second axes C1 and C2, the first axis C1 in this embodiment, can be changed within a plane perpendicular to the axis of the camshaft 22.

The first rocker arm 23 has the same shape as that of the first embodiment above, is disposed between two holders 35 and 35, and is formed from a pair of first arm portions 36 and 36 arranged along a plane perpendicular to the axis of the camshaft 22, and a movable support shaft 37 having the first axis C1 and connecting base portions of the two first arm portions 36 and 36, and opposite end parts of the roller shaft 24 are supported between circular roller support portions 38 and 38 provided at forward ends of the two first arm portions 36 and 36. Furthermore, opposite ends of the movable support shaft 37 projecting outward from the two first arm portions 36 and 36 run through short cylindrical spacers 40 and 40 disposed between the two first arm portions 36 and 36 and a pair of webs 39*a* and 39*a* of a control shaft 39, and are pivotably supported by the two webs 39*a*.

The second rocker arm 26A is formed symmetrically relative to a plane passing through the axial center of the roller 25 and is disposed beneath the first rocker arm 23. It integrally has a cylindrical boss portion 65 pivotably supported on a stationary support shaft 44 having the second axis C2, a pair of second arm portions 66 and 66 extending from the boss portion 65, and a pair of valve connection portions 67 and 67 provided at forward ends of the two second arm portions 66 and 66 so as to be operatively connected to the two intake valves V1 and V2, and sliding surfaces 68 and 68 are provided on upper faces of the two second arm portions 66 and 66, the sliding surfaces 68 and 68 being in sliding contact with a section of the roller shaft 24 between the roller 25 and the roller support portions 38.

The stationary support shaft 44 is fixedly supported on the holders 35, and the pair of second arm portions 46 is provided so as to be connected to axially opposite end parts of the boss portion 65 while extending within a plane perpendicular to the second axis C2 of the fixed support shaft 44.

The valve connection portions 67 are provided so as to be connected to forward end parts of the second arm portions 66 so as to project outward from the forward ends of the two second arm portions 66, that is, toward opposite sides from each other, and tappet screws 49 abutting against upper ends of stem portions 31 of the first and second intake valves V1 and V2 are screwed into the valve connection portions 67 47 so that their positions can be adjusted back and forth.

The second rocker arm 64 is provided with reinforcing wall portions 69 and 69 that provide a connection between the two valve connection portions 67 and outside faces of the two second arm portions 66 and face the roller support portions 38 of the first rocker arm 23. Moreover, the reinforcing wall portions 69 are formed so as to face the roller support portions 38 at a position set back from the sliding surfaces 68 of the second arm portions 66 toward the side opposite to the roller shaft 24.

The first rocker arm 23, which is disposed above the second rocker arm 64, is formed so that at least the roller support portions 38 overlap one of the second rocker arms 64 in plan view, and in this second embodiment it is formed so that parts of the roller support portions 38 of the first rocker arm 23 overlap the reinforcing wall portions 69 in plan view.

Figure 13:
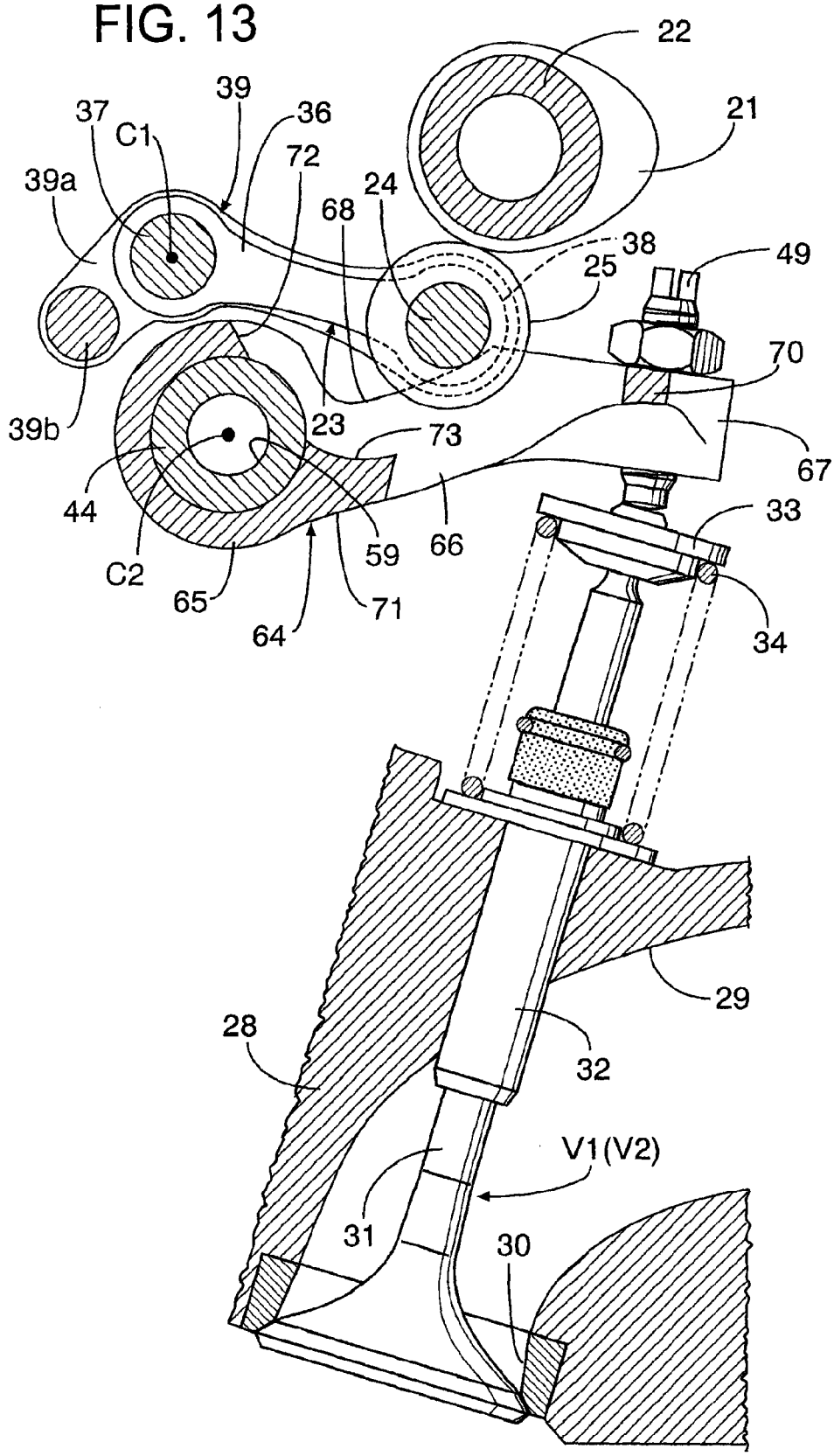
FIG. 13 A sectional view along line 13-13 in FIG. 10 (second embodiment).

In FIG. 13, the second rocker arm 64 is provided with an outside connecting portion 70 integrally connecting forward end parts of the second arm portions 66, and an inside connecting portion 71 integrally connecting base end parts of the second arm portions 66, that is, end parts on the boss portion 65 side.

The boss portion 65 of the second rocker arm 64 is provided with a cutout 72 so that interference with the roller of the first rocker arm 23 is avoided, and the cutout 72 is formed so that part of the outer periphery of the stationary support shaft 44 is exposed. Moreover, the cutout 72 is formed so as to communicate with an upper face of the inside connecting portion 71, and an oil reservoir 73 recessed downward so as to hold oil is formed in the upper face of the inside connecting portion 71 so that oil can be put onto the surface of the roller 25 in response to swinging of the second rocker arm 64.

Figure 14:
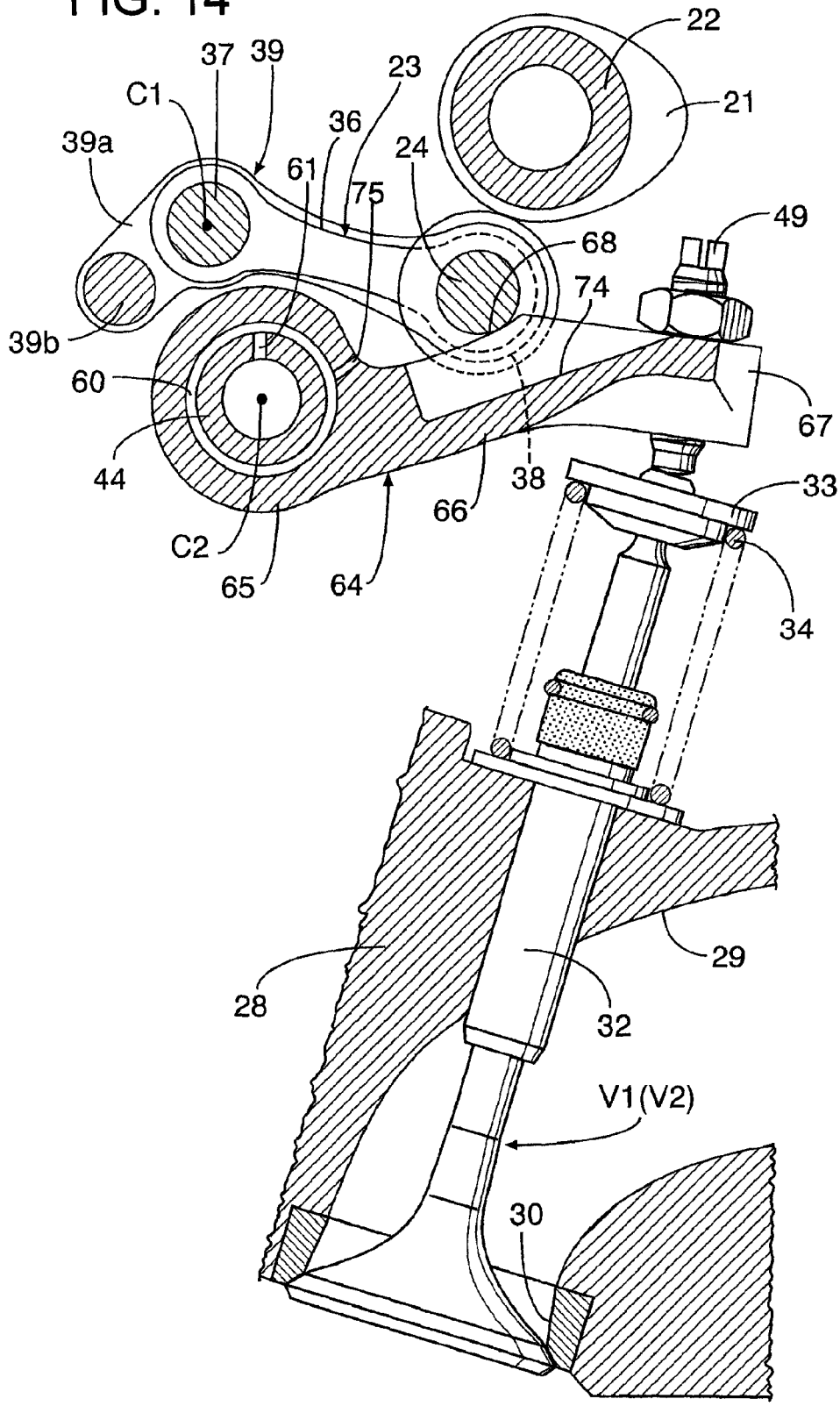
FIG. 14 A sectional view along line 14-14 in FIG. 10 (second embodiment).

In FIG. 14, sliding surfaces 68 having an identical shape are provided on upper faces of the two second arm portions 66 of the second rocker arm 64, and the spacing between these sliding surfaces 68 is set so as to be smaller than the spacing between the first and second intake valves V1 and V2.

Moreover, oil retaining recesses 74 and 74 for retaining oil are formed in the sliding surfaces 68, and these oil retaining recesses 74 are formed as grooves within a plane perpendicular to the axis of the roller shaft 24.

Furthermore, the boss portion 65 of the second rocker arm 64 is provided with a pair of oil outlets 75 and 75 opening toward the pair of oil retaining recesses 74, and these oil outlets 75 communicate with oil supply paths 59 provided within the stationary support shaft 44 via annular recesses 60 and through holes 61.

The operation of the second embodiment is now explained; since at least the roller support portions 38 of the first rocker arm 23 are disposed at positions that overlap the second rocker arm 64 in plan view, it is possible to reduce the amount of displacement of the first rocker arm 23 in a direction along the axis of the camshaft 22 relative to the second rocker arm 64, which is operatively connected to the first and second intake valves V1 and V2, thus enabling the valve operating system to be reduced in size in the direction along the axis of the camshaft 22.

Moreover, since the spacing between the pair of sliding surfaces 68 of the single second rocker arm 64 is set so as to be smaller than the spacing between the first and second intake valves V1 and V2, regardless of the position at which the first rocker arm 23 is disposed in the direction along the axis of the camshaft 22 relative to the sliding surfaces 68 of the second rocker arm 64, since the sliding surfaces 68 of the second rocker arm 64 are disposed in a section that is narrower than the spacing between the first and second intake valves V1 and V2, the valve operating system can be reduced in size in the direction along the axis of the camshaft 22.

Furthermore, since the spacing between the sliding surfaces 68 is made smaller than the spacing between the two intake valves V1 and V2, the pair of valve connection portions 67 of the second rocker arm 64 are inevitably disposed so as to project outward from the forward ends of the second arm portions 66 and 66 having the sliding surfaces 68 and 68, but since the outside faces of the second arm portions 66 and the valve connection portions 67 are connected via the reinforcing wall portions 69, the rigidity of the joints between the valve connection portions 67 and the second arm portions 66 can be enhanced.

Furthermore, since the reinforcing wall portions 69 are formed so as to face the roller support portions 38 at positions set back from the sliding surfaces 68 toward the side opposite to the roller shaft 24, it is possible to avoid any increase in the vertical width of the second rocker arms 64 due to the reinforcing wall portions 69 being provided.

Moreover, since the outside connecting portion 70 integrally connecting the forward end parts of the second arm portions 66 and the inside connecting portion 71 integrally connecting the base end parts of the second arm portions 66 are provided on the second rocker arm 64, the rigidity of the second rocker arm 64 can be enhanced, and it is possible to make the two intake valves V1 and V2 accurately follow the profile of the valve operating cam 21 so as to be opened and closed.

Since the boss portion 65 of the second rocker arm 64 is provided with the cutout 72 so that interference with the roller 25 is avoided, even when the sliding surfaces 68 are disposed close to the stationary support shaft 44, which swingably supports the boss portion 65 of the second rocker arm 64, it is possible to avoid the roller 25 of the first rocker arm 23 interfering with the boss portion 65, thus enabling the length of the second rocker arm 64 to be set short and thereby contributing to a reduction in the size of the valve operating system.

Moreover, since the cutout 72 is formed so that part of the outer periphery of the stationary support shaft 44 is exposed, it is possible to guide oil from the cutout 72 to the area between the stationary support shaft 44 and the boss portion 65, thus enabling the area between the second rocker arm 64 and the stationary support shaft 44 to be well lubricated.

Furthermore, since the downwardly recessed oil reservoir 73 for holding oil is formed in the upper face of the inside connecting portion 71 so that oil can be put onto the surface of the roller 25 in response to swinging of the second rocker arm 64, the area between the roller 25 and the valve operating cam 21 can be well lubricated.

Moreover, the oil retaining recesses 74, which can retain oil, are formed in the sliding surfaces 68 of the second rocker arm 64, and by holding oil in the oil retaining recesses 74 oil can be supplied to the area between the roller shaft 24 and the sliding surfaces 68, thereby reducing the frictional resistance between the roller shaft 24 and the sliding surfaces 68.

Moreover, since the oil retaining recesses 74 are formed as grooves within the plane perpendicular to the axis of the roller shaft 24, the oil retaining recesses 74 can easily be formed across the whole area over which the sliding surfaces 68 are in sliding contact with the roller shaft 24.

Furthermore, since the oil outlets 75, which communicates with the oil supply path 59 provided within the stationary support shaft 44 and discharges oil toward the oil retaining recesses 74, are provided in the boss portion 65 of the second rocker arm 64, it is possible to reliably supply oil to the oil retaining recesses 74.

Embodiments of the present invention are explained above, but the present invention is not limited to the above-mentioned embodiments and may be modified in a variety of ways as long as the modifications do not depart from the present invention described in Claims.

The invention claimed is:

1. An engine valve operating system comprising a camshaft (22) having a valve operating cam (21) provided thereon, a first rocker arm (23) that can swing around a first axis (C1) parallel to an axis of the camshaft (22), a roller (25) that is axially supported, via a roller shaft (24), on a roller support portion (38) provided on the first rocker arm (23) and that is in rolling contact with the valve operating cam (21), and a second rocker arm (26A, 26B, 64) that has a sliding surface (48A, 48B, 68) in sliding contact with the roller shaft (24), is operatively connected to an engine valve (V1, V2), and can swing around a second axis (C2) parallel to the first axis (C1), the position of either one of the first and second axes (C1, C2) changing within a plane perpendicular to the axis of the camshaft (22), characterized in that at least the roller support portion (38) of the first rocker arm (23) is disposed at a position that overlaps the second rocker arm (26A, 26B, 64) in plan view.

2. The engine valve operating system according to claim 1, wherein the second rocker arm (26A, 26B, 64) is provided with a cylindrical boss portion (45, 65) pivotably supported on a support shaft (44) that has the second axis (C2) and with an arm portion (46, 66) that has the sliding surface (48A, 48B, 68) and extends from the boss portion (45, 65), and the boss portion (45, 65) is provided with a cutout (52, 53, 72) so that it avoids interfering with at least one of the roller (25) and the roller support portion (38) of the first rocker arm (23).

3. The engine valve operating system according to claim 2, wherein the boss portion (45) is provided with the cutout (52, 53) so as to avoid interfering with the roller (25) and the roller support portion (38).

4. The engine valve operating system according to claim 2, wherein the cutout (52, 53, 72) is formed so that part of the outer periphery of the support shaft (44) is exposed.

5. The engine valve operating system according to claim 4, wherein an oil guide surface (54, 55) communicating with the cutout (52, 53) is formed on the second rocker arm (26A, 26B) so as to face upward.

6. The engine valve operating system according to claim 1, wherein the second rocker arm (26A, 26B, 64) comprises a cylindrical boss portion (45, 65) pivotably supported on a support shaft (44) that has the second axis (C2), an arm portion (46, 66) that has the sliding surface (48A, 48B, 68) and extends from the boss portion (45, 65), and a reinforcing wall portion (50, 51) provided between the boss portion (45) and a side face of the arm portion (46).

7. The engine valve operating system according to claim 6, wherein the reinforcing wall portion (50, 51) facing the roller support portion (38) or the roller (25) is formed at a position set back from the sliding surface (48A, 48B) toward the side opposite to the roller shaft (24).

8. The engine valve operating system according to claim 1, wherein the second rocker arm (26A, 26B, 64) comprises a cylindrical boss portion (45, 65) pivotably supported on a support shaft (44) that has the second axis (C2), and an arm portion (46, 66) that has the sliding surface (48A, 48B, 68) and extends from the boss portion (45, 65), and a pair of the arm portions (66) having valve connection portions (67) provided on a forward end part are integrally connected to each other via a connecting portion (70, 71), the valve connection portions (67) being operatively connected to the engine valves (V1, V2).

9. The engine valve operating system according to claim 8, wherein an oil reservoir (73) for holding oil is formed in the connecting portion (71) so that oil can be put onto the surface of the roller (25) in response to swinging of the second rocker arm (64).

10. The engine valve operating system according to claim 1, wherein an oil retaining recess (57A, 57B, 74) for holding oil is formed in the sliding surface (48A, 48B, 68) of the second rocker arm (26A, 26B, 64).

11. The engine valve operating system according to claim 10, wherein the oil retaining recess (57A, 57B, 74) is formed as a groove within a plane perpendicular to the axis of the roller shaft (24).

12. The engine valve operating system according to claim 10, wherein the second rocker arm (26A, 26B, 64), which is pivotably supported by a support shaft (44) that has the second axis (C2), is provided with an oil outlet (58, 75) that communicates with an oil supply path (59) provided within the support shaft (44) and discharges oil toward the oil retaining recess (57A, 57B, 74).

13. The engine valve operating system according to claim 11, wherein the oil retaining recess (57B) is formed so as to gradually become shallow in going toward the second axis (C2) side.

14. An engine valve operating system comprising a camshaft (22) having a valve operating cam (21) provided thereon, a first rocker arm (23) that can swing around a first axis (C1) parallel to an axis of the camshaft (22), a roller (25) that is axially supported, via a roller shaft (24), on a roller support portion (38) provided on the first rocker arm (23) and that is in rolling contact with the valve operating cam (21), and a second rocker arm (26A, 26B, 64) that has a sliding surface (48A, 48B, 68) in sliding contact with the roller shaft (24), is operatively connected to an engine valve (V1, V2), and can swing around a second axis (C2) parallel to the first axis (C1), the position of either one of the first and second axes (C1, C2) changing within a plane perpendicular to the axis of the camshaft (22), characterized in that a spacing between the sliding surfaces (48A, 48B, 68) individually corresponding to a plurality of the engine valves (V1, V2) is set so as to be smaller than a spacing between the engine valves (V1, V2).

15. The engine valve operating system according to claim 14, wherein the second rocker arm (26A, 26B, 64) integrally comprises a boss portion (45, 65) pivotably supported on a support shaft (44) that has the second axis (C2), an arm portion (46, 66) that has the sliding surface (48A, 48B, 68) and extends from the boss portion (45, 65), a valve connection portion (47, 67) that projects outward from the forward end of the arm portion (46, 66) and is operatively connected to the engine valve (V1, V2), and a reinforcing wall portion (50, 69) that provides a connection between the valve connection portion (47, 67) and an outside face of the arm portion (46, 66).

* * * * *